United States Patent [19]

Sakurada et al.

[11] 4,212,649

[45] Jul. 15, 1980

[54] METHOD FOR MANUFACTURING HEAT-RESISTANT AND FLAME-RETARDANT SYNTHETIC FIBER

[75] Inventors: Ichiro Sakurada, Kyoto; Toshio Okada, Kadoma; Kanako Kaji, Osaka, all of Japan

[73] Assignee: Japan Atomic Energy Research Institute, Tokyo, Japan

[21] Appl. No.: 828,202

[22] Filed: Aug. 26, 1977

[30] Foreign Application Priority Data

Mar. 1, 1977 [JP] Japan ..... 52-20906

[51] Int. Cl.[2] ..... D06M 10/00; D06M 15/38

[52] U.S. Cl. ..... 8/115.5; 8/DIG. 12; 8/DIG. 18; 204/159.17

[58] Field of Search ..... 8/115.5, DIG. 18, DIG. 12; 204/159.17

[56] References Cited

U.S. PATENT DOCUMENTS 2,979,446 4/1961 Anderson ..... 8/DIG. 18

2,999,056 9/1961 Tanner ..... 204/159.17

FOREIGN PATENT DOCUMENTS 875131 8/1961 United Kingdom ..... 8/DIG. 18

*Primary Examiner*—John Kight, III

*Attorney, Agent, or Firm*—Oblon, Fisher, Spivak, McClelland & Maier

[57] ABSTRACT

A method for manufacturing heat-resistant polyvinyl chloride fiber is given without injuring the flame-retardance of the polyvinyl chloride fiber, by grafting acrylic acid or calcium acrylate onto polyvinyl chloride by a radiation chemical process. The polyvinyl chloride fiber is irradiated either in contact with a mixture of water, ethylene dichloride and acrylic or in contact with a mixture of methanol, water, ethylene dichloride and calcium acrylate. In the case of the grafting of acrylic acid the graft fiber is subjected to a heat treatment or grafted polyacrylic acid is converted to a divalent metal salt.

14 Claims, No Drawings

METHOD FOR MANUFACTURING HEAT-RESISTANT AND FLAME-RETARDANT SYNTHETIC FIBER

BACKGROUND OF THE INVENTION

1. Field of the Invention

The present invention relates to a method for manufacturing heat-resistant and flame-retardant polyvinyl chloride fiber by grafting acrylic acid or its divalent metal salts onto polyvinyl chloride by irradiating the fiber with an ionizing radiation in the presence of ethylene dichloride, water and acrylic acid or in the presence of ethylene dichloride, methanol, water and calcium acrylate.

2. Description of the Prior Art

Polyvinyl chloride fiber has many advantages as a synthetic fiber, among which the flame retardance is an almost unique one. However, it has also a drawback, that the heat resistance is so low that the fiber shows remarkable heat shrinkage even below 100° C. The most practical method to raise the heat-resistance i.e. the temperature of heat shrinkage is to use random copolymer of vinyl chloride and acrylonitrile in a ratio about 60:40. Such a fiber is commercially produced. The inventors of the present invention have previously presented an invention providing a method for improving the heat-resistance of polyvinyl chloride fiber by graft-copolymerizing acrylonitrile onto polyvinyl chloride. The graft-copolymer fiber shows even at 300° C. no shrinkage. However, it was necessary to graft-copolymerize acrylonitrile in an amount about 100% by weight based on the starting polyvinyl chloride fiber in order to render the fiber sufficiently heat-resisting. Therefore, the flame-resistance of the polyvinyl chloride fiber was to a certain extent lost owing to such a large amount of the graft-copolymerized acrylonitrile.

On the other hand, it is known by those skilled in the art that the heat-shrinking of the polyvinyl chloride fiber can be mitigated by radiation grafting of acrylic acid, especially by further treatment of the graft fiber with a metallic salt. (See, for example, Tsuji, Ikeda and Kurokawa: Sen-i Gakkai-shi, vol. 23, page 335, 1967). However, mention is found neither on the flame-retardance of the graft fiber nor on the direct grafting of calcium acrylate onto polyvinyl chloride, and the method of rapid and effective grafting was not critically studied.

SUMMARY OF THE INVENTION

A method for manufacturing grafted polyvinyl chloride fiber is given by the present invention. The method of the invention has an object to provide heat-resistance to polyvinyl chloride fiber without injuring the flame-retardance of the polyvinyl chloride fiber.

The invention is a method for manufacturing heat-resistant and flame-retardant polyvinyl chloride fiber grafting acrylic acid or calcium acrylate onto polyvinyl chloride by irradiating polyvinyl chloride fiber impregnated with a mixture comprising water (or water+methanol), ethylene dichloride and acrylic acid or calcium acrylate with ionizing radiation.

The method of the invention is classified into three modes. They are:

(the first mode)

a method comprising successive steps of ($a_1$) impregnating polyvinyl chloride fiber with a ternary mixture of acrylic acid, water and ethylene dichloride, in such a composition that the volume ratio of acrylic acid to water is at least 30/70 and the amount of ethylene dichloride added to the acrylic acid solution is within the range of from 90 to 110% of the amount above which the phase separation of the homogeneous ternary mixture occurs, ($b_1$) irradiating the impregnated polyvinyl chloride fiber with ionizing radiation to induce graft-copolymerization of acrylic acid at least up to 15% graft by weight of the original fiber, and ($c_1$) subjecting the grafted fiber to a heat treatment of converting the graft-copolymerized acrylic acid to a salt of a divalent metal by contacting the grafted fiber to aqueous solution of a water-soluble divalent metal salt, (the second mode)

a method comprising a step of irradiating polyvinyl chloride fiber with ionizing radiation in contact with a mixture of calcium acrylate, water methyl alcohol and ethylene dichloride. The amount of ethylene dichloride is such that it just causes phase separation of the mixture. The mixture contains further, at least one of the water-soluble metallic salts selected from a group consisting of ferrous, ferric, cuprous and cupric salts to inhibit the polymerization of calcium acrylate outside of the fiber. The necessary percent graft of calcium acrylate is at least 15% by weight based on the starting fiber, and (the third mode)

a method comprising successive steps of ($a_3$) impregnating polyvinyl chloride fiber with a binary mixture of ethylene dichloride and methyl alcohol in a volume ratio between 40:60 and 30:70, and ($b_3$) irradiating the impregnated polyvinyl chloride fiber with ionizing radiation in contact with an aqueous solution of calcium acrylate containing at least one of the water-soluble metallic salts selected from a group consisting of ferrous, ferric, cuprous salts and cupric salts to inhibit the polymerization of calcium acrylate outside of the fiber. The necessary percent graft of calcium acrylate is at least 15% by weight based on the starting fiber.

DETAILED DESCRIPTION OF THE PREFERRED EMBODIMENTS

The present invention relates to a method for manufacturing heat-resistant and flame-retardant polyvinyl chloride fiber by radiation induced grafting of acrylic acid on to the fiber in the presence of ethylene dichloride and water. Particularly, the invention relates to a method for manufacturing heat-resistant polyvinyl chloride fiber i.e. fiber with high temperature of heat-shrinkage.

Polyvinyl chloride fiber is produced commercially owing to the low cost and the excellent properties as a synthetic fiber. However, the actual use of the polyvinyl chloride fiber is restricted because of its poor heat-resistance such that the fiber shows marked shrinkage even below 100° C.

A great advantage of polyvinyl chloride fiber is that it is flame retardant or self-extinguishing. That is, the fiber burns when contacted directly to a flame but is extinguished spontaneously when removed from the flame. It is expected that the use of the polyvinyl chloride fiber will be by far expanded by raising the temperature of heat-shrinkage and by improving other properties such as the dyeability without suppressing the self-extinguishing property and the mechanical strength proper to the untreated polyvinyl chloride fiber.

The inventors of the present invention have succeeded in providing a method for manufacturing heat-resistant synthetic fiber from polyvinyl chloride fiber without injuring the favorable mechanical and self-extinguishing properties of the starting fiber by grafting acrylic acid or calcium acrylate.

The method for manufacturing heat-resistant and flame retardant synthetic fiber according to the present invention is classified into three modes.

The first mode of the method comprises successive steps of ($a_1$) impregnating polyvinyl chloride fiber with a ternary mixture of acrylic acid, water and ethylene dichloride, in such a composition that the volume ratio of acrylic acid to water is at least 30/70 and the amount of ethylene dichloride added to the acrylic acid solution is within the range of from 90 to 110% of the amount above which the phase separation of the homogeneous ternary mixture occurs, ($b_1$) irradiating the impregnated polyvinyl chloride fiber with ionizing radiation to induce grafting of acrylic acid at least up to 15% graft by weight of the starting fiber, and ($c_1$) subjecting the grafted fiber to a heat treatment or converting the graft-copolymerized acrylic acid to a salt of a divalent metal by contacting the grafted fiber to an aqueous solution of a water-soluble divalent metal salt.

It is known that ethylene dichloride is a swelling agent for polyvinyl chloride, and that the grafting reaction takes place easily in the presence of a swelling agent. However, when a binary mixture of acrylic acid and ethylene dichloride is used for the grafting, the swelling power of the mixture to the fiber is so strong that it is partially disintegrated and it is not suitable for the purpose. Binary mixture of acrylic acid and water also is not suitable because polymerization takes place only outside of fiber without grafting. Therefore, ternary mixtures of acrylic acid/water/ethylene dichloride were studied in detail. When we add a small amount of ethylene dichloride the grafting reaction begins to take place. The rate of the grafting increases with increasing amount of ethylene dichloride to show a very rapid increase of the rate of grafting when the amount of ethylene dichloride in the mixture reaches just the lower limit of the above specified range. This is due to the easier adsorption of acrylic acid by polyvinyl chloride from the ternary mixture near the composition of the phase separation, hence easier grafting of acrylic acid to polyvinyl chloride. When the amount of ethylene dichloride is greater than the upper limit of the above specified. The mixture is no more homogeneous by phase separation, and the separated ethylene dichloride solution of acrylic acid swells and shrinks polyvinyl chloride fiber to a larger extent so that the mechanical properties of the fiber is injured. The homopolymerization of acrylic acid outside of the polyvinyl chloride fiber can be suppressed by the addition of a water-soluble ferrous salt such as Mohr's salt or a water-soluble cupric salt such as cupric sulfate in an amount between $5\times10^{-2}$ and $10^{-3}$ mole/liter into the soaking solution. However, the addition of these metal salts into the soaking solution is not so essential in the first mode of the method of the present invention.

As for the ionizing radiation used for irradiating the impregnated polyvinyl chloride fiber, electron beams generated by an electron accelerator is preferred than the other kinds of the ionizing radiations such as gamma rays emitted from cobalt-60. The preferred dose rate of the electron beams is from $1.0\times10^3$ to $1.0\times10^7$ rad/-second, particularly from $1.0\times10^4$ to $1.0\times10^7$ rad/-second. The preferred range of the total dose of the ionizing radiation is not less than 0.1 Mrad and not exceeding 2 Mrad, particularly not exceeding 1 Mrad in order to avoid deterioration or coloring of the fiber.

The heat-resistance of the polyvinyl chloride fiber is improved by heating the fiber at a temperature from 100° to 240° C., particularly from 150° to 200° C. for 1 second to 10 minutes, particularly for 10 seconds to 5 minutes following to the graft-copolymerization.

The alternative method is to form ionically cross-linked structures within the portions of the polyacrylic acid grafts with a divalent metal salt, which is selected from calcium acetate, zinc acetate, cupric acetate, nickel acetate and lead acetate.

The second mode of the method comprises a step of irradiating the polyvinyl chloride fiber with ionizing radiation in contact with a mixture of calcium acrylate, water, methyl alcohol and ethylene dichloride. Ethylene dichloride is added up to an amount just sufficient to cause the phase separation. The mixture contains at least one water-soluble metallic salt selected from a group consisting of ferrous, ferric, cuprous and cupric salts to suppress homopolymerization of calcium acrylate outside of the fiber.

The above mentioned composition of the soaking solution is necessary to carry out the grafting reaction smoothly and effectively. Ethylene dichloride is a swelling agent for polyvinyl dichloride and not only contribute to the diffusion of calcium acrylate into the fiber but also to formation of free radicals by the irradiation which initiate polymerization of calcium acrylate in the fiber. Water is a good solvent for calcium acrylate and the iron and copper salts used to inhibit or suppress homopolymerization outside of the fiber. Methanol is used to control the compatibility of water and ethylene dichloride.

The composition of the mixture should be such that the resultant solution is homogeneous. A concentration of calcium acrylate in the mixture not less than 5% by weight is preferred. A typical example of the soaking solution is a mixture obtained by adding 20 to 100 parts by volume of methyl alcohol to 100 parts by volume of an aqueous solution of calcium acrylate whose concentration is between 20 and 50% by weight; ethylene dichloride is successibly added up to an amount just to cause the phase separation. It cannot be incorporated in the mixture in an amount sufficient to accelerate the graft-copolymerization when the amount of methyl alcohol is too small, and, on the contrary, the use of an excess amount of methyl alcohol is not preferred because of the precipitation of calcium acrylate.

The water-soluble metallic salt used to prevent the homo-polymerization of calcium acrylate is selected from ferrous chloride, Mohr's salt (salts of divalent iron), ferric chloride (a salt of trivalent iron), cuprous chloride (a salt of monovalent copper), cupric sulfate (a salt of divalent copper) and the like. The concentration of these water-soluble salt in the final mixture in the range from $10^{-3}$ to $10^{-1}$ mole/liter is preferred.

The polyvinyl chloride fiber is irradiated with ionizing radiation such as gamma rays emitted from cobalt-60, electron beams generated by an electron accelerator and the like in contact with the above acrylate mixture.

Thus, calcium acrylate is graft-copolymerized onto the polyvinyl chloride fiber. The fiber containing 15% by weight or more of grafted polyacrylate prepared by the method shows low shrinkage even at high temperature and is self-extinguishing. Further, the second mode of the present method has an advantage that the polyvinyl chloride fiber grafted with acrylate is obtained via an operation in a single step instead of the two step treatment conventionally applied.

The third mode of the method for manufacturing heat-resistant and flame-retardant synthetic fiber according to the present invention comprises successive steps of ($a_3$) impregnating the polyvinyl chloride fiber with a binary mixture of ethylene dichloride and methyl alcohol in a volume ratio between 40:60 and 30:70, and ($b_3$) irradiating the impregnated polyvinyl chloride fiber with ionizing radiation in contact with an aqueous solution of calcium acrylate containing at least one water-soluble metallic salts selected from a group consisting of ferrous, ferric, cuprous and cupric salts to effect graft-copolymerization of calcium acrylate in an amount at least 15% by weight based on the starting fiber.

In this mode of the method for manufacturing grafted polyvinyl chloride fiber, the ratio of ethylene dichloride and methyl alcohol in the binary mixture used for impregnating the fiber is essential. The volume ratio of ethylene dichloride/methyl alcohol in the mixture should not be greater than 40/60 in order to avoid marked shrinkage and partial dissolution of the fiber which injure the quality of the products. On the other hand, no desirable fiber with sufficient heat-resistance is obtained when a soaking solution containing more methyl alcohol than the volume ratio of 30/70 is used, because the graft-copolymerization is retarded.

Next, the polyvinyl chloride fiber impregnated with the binary mixture of ethylene dichloride and methyl alcohol is irradiated with an ionizing radiation in contact with aqueous solution of calcium acrylate, whose concentration is at least 5% by weight, the concentration of ferrous, ferric salts, cuprous or cupric salts should be between $10^{-3}$ to $10^{-1}$ mole/liter. As ionizing radiation, either gamma rays emitted from a cobalt-60 source or electron beams generated by an electron accelerator is used. The irradiation is carried out either in the state that the fiber is dipped in the solution or alternatively after removal of the fiber from the solution.

Using either the second or the third mode of the method of the invention, polyvinyl chloride fiber grafted with calcium acrylate at least 15% by weight is easily obtained. The grafted fiber shows little shrinkage on heating and is self-extinguishing.

In the second and the third mode of the method the temperature of the fiber during the irradiation is not essential but the room temperature is preferred. The dose rate of the ionizing radiation is determined depending on the kind of the ionizing radiation, but a does rate in the range from 1 to $10^7$ rad/second, particularly from 10 to $10^6$ rad/second is preferred in general. There is essentially no limit to the total dose of the radiation so long as the desired percent graft is attained, but a total dose of not less than 0.1 Mrad and not exceeding 2 Mrad, particularly not exceeding 1 Mrad is preferred to prevent deterioration or the coloring of the fiber.

The second mode and the third mode of the method according to the present invention have additional advantages over the first mode of the method previously explained. The offensive odor of the acrylic acid is eliminated since a metallic salt of acrylic acid with a lower vapor pressure is used instead of acrylic acid. The use of a metallic salt of acrylic acid also eliminates the troublesome corrosion of the reaction vessel made of iron or steel in the acidic environment. Furthermore, the graft-copolymerization is carried out in a single step of the operation in these modes of the method instead of the two-steps operations in the first mode of the method.

Heretofore no direct method for the grafting of metallic salt of acrylic acid such as calcium acrylate and the like onto hydrophobic synthetic polymer is known. However, a method is known for grafting calcium acrylate onto a hydrophillic natural polymer such as cotton cloth with printed patterns by heating with the aid of ammonium persulfate as the polymerization initiator after impregnating the cloth with an aqueous solution of the acrylate.

In the present specification, the term "percent graft" means the percent of the weight increase by the grafting of acrylic acid or acrylate after extraction of the homopolymer. The percent grafting should be at least 15% in order to give sufficient resistance to heat i.e. to give sufficiently high temperature of heat-shrinkage to the polyvinyl chloride fiber. The grafted polyvinyl chloride fiber with a grafting ratio of less than 15% would not show sufficient resistance heat-shrinkage. The upper limit of the percent graft is not strictly given, but percent of not exceeding 100%, particularly not exceeding 70% is preferred usually. The grafted polyvinyl chloride fiber with percent graft in the specified range has high temperature of heat-shrinkage, sufficient flame-retardance and dyeability.

The polyvinyl chloride fiber used as the starting material in the method of the invention may be selected from fiber made of vinyl chloride homopolymer or fiber made of copolymer of vinyl chloride containing minor amount of acrylonitrile, vinyl acetate, vinylidene chloride and the like. The form of the fiber subjected to the treatment is not restricted; it may be filament, tow, spun yarn, fabric or the like.

The method for manufacturing heat-resistant and flame-retardant synthetic fiber according to the present invention is further explained in details by the following examples but without the object of restricting the scope of the invention.

EXAMPLE 1

About 0.5 g of polyvinyl chloride fiber obtained from the market (with registered trade name "Tevilon", manufactured by Teijin Company, Japan; 75 denier/25 filaments) was dipped in a soaking solution after successive washings with distilled water and ethyl alcohol and drying under a reduced pressure. The soaking solution was prepared by adding 13 ml of ethylene dichloride to 100 ml of a binary mixture consisting of acrylic acid and water in a volume ratio (in each of the examples hereinafter the compositions of the mixture containing the acrylic monomer is expressed in volume) of 50:50 and admixed with 0.2 g of Mohr's salt (ferrous ammonium sulfate) to obtain a concentration of $5\times10^{-3}$ mole/liter in the binary mixture. The amount of ethylene dichloride 13 ml is 7.1% less than 14 ml which was the critical amount of ethylene dichloride just to cause phase separation of 100 ml of the above binary mixture at 23° C. The fiber was removed from the solution after 1 minute's soaking and the excess solution on the surface of the fiber was squeezed out by inserting the fiber between filter papers. The impregnated fiber contained 100% by weight of the solution based on the fiber. The fiber was then put in a bag made of an aluminium foil laminated with polyethylene film, and nitrogen gas was introduced to replace air in the bag and sealed without delay. The fiber in the bag was irradiated on a coveyor with electron beams of 1.5 MeV and 50 $\mu$A. The conveyor passed under the irradiation window of the accelerator with a velocity of 48 cm/minutes.

The dose rate and the total dose of irradiation were 0.1 Mrad/second a 0.2 Mrad respectively. After the irradiation the fiber was taken out from the bag and successively washed with hot water of 50° C. and ethyl alcohol to remove the solvent and the water-soluble homopolymer. The percent grafting, the weight increase, of the fiber was 33.4% after drying.

The grafted fiber was then treated with an aqueous solution of calcium acetate, 1% in concentration, at 50° C. for 2 hours to convert the polyacrylic acid grafts to calcium salt.

Hot water stability of the grafted fiber was tested after conversion to calcium salt. The shrinkage of the grafted fiber after 1 hour dipping in boiling water was improved to 9% from 40% of the starting polyvinyl chloride fiber. Also the shrinkage of the grafted fiber after heating to 150° C. and 200° C. at a rate of heating of 5° C./minute in air were 4.0% and 4.5%, respectively. Further, the shrinkage after heating to 300° C. was 5% and the fiber was not broken. The starting polyvinyl chloride fiber started shrinking at 70° C., the shrinkage reached 60% at 170° C. and the fiber was broken at 180° C.

The grafted polyvinyl chloride fiber has excellent dyeability especially with cationic dyestuffs, whereas the starting polyvinyl chloride fiber can not be dyed with the same dyestuff.

Finally the flame-resistance of the grafted fiber was tested. A bundle of 0.2 g grafted fiber with a length of 6 cm was prepared, hung down with cotton yarn and contacted to a flame with a length of 15 cm at the lower end of the bundle. It is certain that the grafted fiber of the invention is self-extinguishing from the observation that the fiber burned faintly only in contact with flame but was immediately extinguished when the flame was removed. The tensile strength of the grafted fiber was 11.9 g.

EXAMPLE 2

An experiment similar to Example 1 was carried out using the same experimental conditions except that the polyvinyl chloride fiber was impregnated with 70% aqueous solution of acrylic acid without adding Mohr's salt instead of 50% aqueous solution of acrylic acid containing Mohr's salt and that the solution was squeezed out to obtain an impregnation ratio of 70%. The percent graft of the treated fiber was 20.1% and had good dyeability to the same dyestuff as in Example 1. The shrinkage of the fiber at 150° C. and 200° C. in air were 6.0% and 6.5%, respectively. The tensile strength of the treated fiber was 11.5 g.

EXAMPLE 3 and EXAMPLE 4

Experiments were carried out similarly to Example 1 except that the amounts of ethylene dichloride incorporated into the soaking solution were 14 ml (in Example 3) and 15 ml (in Example 4), respectively.

The percent graft were 36.0% and 36.3%, respectively, and each of the treated fiber had good-dyeability to the same dyestuff. The heat-shrinkage at 150° C. and 200° C. were 3.5% and 4.0% in Example 3, and 4.0% and 4.5% in Example 4, respectively. The strengths of the grafted fibers estimated using an Instron Tester were 10.8 g and 12.1 g, respectively, showing no deterioration as compared with 11.6 g of the starting fiber.

EXAMPLE 5

A homogeneous quaternary mixture of calcium acrylate-water-methyl alcohol-ethylene dichloride with a weight ratio of 16:39:39:6 was prepared, and ferrous chloride was added in an amount to give a concentration of $10^{-2}$ mole/liter. About 0.5 g of polyvinyl chloride fiber washed with water and ethyl alcohol as in Example 1 was dipped in the mixture and irradiated with gamma rays emitted from a cobalt-60 at a dose rate of $2.0\times10^3$ rad/hour for 2 hours under an atmosphere at nitrogen gas. The soaking solution had slight turbidity due to the homopolymer of calcium acrylate formed outside of the fiber. The fiber was taken out from the solution and washed successively with water and ethyl alcohol. The homopolymer of calcium acrylate did not agglomerate around the fiber and was easily removed. The percent graft was 20.8%.

The grafted fiber was heated with a rate of 5° C./minute to 150° C.; the shrinkage of the fiber was 23%. It is certain that the heat-shrinkage is notably mitigated by the graft-copolymerization of calcium acrylate, because the heat shrinkage of the starting fiber was 60% under the same condition.

The dyeability, the flame-resistance and the strength of the grafted fiber were tested in a similar way as to the preceding examples. The fiber had well-dyeability, sufficient flame resistance and a strength of 11.8 g.

COMPARATIVE EXAMPLE 1

Calcium acrylate did not dissolve in the monomer mixture when water was eliminated from the quaternary solution. The elimination of methyl alcohol from the quaternary solution made ethylene dichloride incompatible and caused partial dissolution of the fiber thus giving only agglomerated fiber by the treatment. The graft-copolymerization was not observed altogether when ethylene dichloride was eliminated from the quaternary solution.

Calcium acrylate was homopolymerized and the mixture solidified when the monomer mixture was used without an addition of ferrous chloride so that the individual fiber could hardly be separated. The fibers were glued together even after the removal of the homopolymer of calcium acrylate.

EXAMPLE 6 to EXAMPLE 8

Similar experiments to Example 5 were carried out except that several kinds of water-soluble metallic salts other than ferrous chloride were added to the monomer mixture in a concentrateion of $10^{-2}$ mole/liter in each example. The results of the experiments are shown in the following Table 1. The conditions of the testings were the same as in the preceding examples.

Table 1

| Ex. Nos. | Metallic Salt | Time of Irrad'n (hrs) | Percent Graft | Condition of Monomer Sol'n Outside of Fiber | Shrinkage at 150° C. (%) | Dyeability | Tensile Strgth (g) |
|---|---|---|---|---|---|---|---|
| 6 | cuprous chloride | 3 | 26.5 | turbid | 22 | good | 12.0 |
| 7 | cupric sulfate | 2 | 16.8 | turbid | 25.5 | good | 10.7 |
| 8 | ferric chloride | 2 | 23.7 | containing white precipitate | 24 | good | 11.8 |

In every cases where a water-soluble metallic salt selected from cuprous chloride, cupric sulfate and ferric chloride was added to the soaking solution, the homopolymer formed in the liquid phase outside of fiber was white precipitate or only turbidity, therefore the homopolymer was easily removed by washing with water and ethyl alcohol from the fiber. The grafted fibers showed no gluing, but good-dyeability and mitigated shrinkage by heating as compared with the starting fiber. The strength of the fiber did not decrease by the grafting. The preservation of the self-extinguishing property in the grafted fibers was proved by the testings for the flame-retardance.

EXAMPLE 9

An experiment was carried out in a similar way as to Example 5 but the fiber was irradiated with electron beams. The fiber was dipped in the same soaking solution as in Example 5 for 2 minutes, taken out from the solution and pressed gently to impregnate fiber with an equal amount of the solution to the fiber. The fiber was then put in a bag made of an aluminium foil laminated with polyethylene film. After passing nitrogen gas to replace air in the bag and sealing of the bag, the fiber was irradiated with electron beams of 1.5 MeV and an 50 $\mu$A generated by a Van de Graaff-type accelerator for 15 seconds at a dose rate of 0.1 Mrad/second. The unreacted calcium acrylate and the homopolymer of calcium acrylate were removed by the same treatment as in Example 5. The percent grafting was 18.3%.

The grafted fiber showed no gluing and was in a satisfactory condition. The shrinking of the grafted fiber at 150° C. was 24.7%. The dyeability by cationic dyestuffs was also satisfactory and the self-extinguishing property was retained. The strength of the grafted fiber was 10.3 g.

Thus improved synthetic fiber with good heat-stability is obtained without injuring the flame-retardance and the strength.

EXAMPLE 10

About 0.5 g of the polyvinyl chloride fiber as used in Example 5 was soaked for one hour in a binary mixture of ethylene dichloride and methyl alcohol mixed in a volume ratio of 30:70. After the soaking, the fiber was taken out from the mixture and the impregnated fiber was again dipped in an aqueous solution of calcium acrylate of 20% in concentration, which contained Mohr's salt in a concentration of $10^{-2}$ mole/liter. After bubbling the aqueous solution with nitrogen gas for 2 minutes, the fiber was irradiated with gamma rays emitted from cobalt-60 with a dose rate of $2.5\times10_4$ rad/hr for 3 hours. The formation of the homopolymer of calcium acrylate outside of the fiber was so slight that the solution became slightly turbid. The irradiated fiber was taken out from the solution and successively washed with water and ethyl alcohol. The homopolymer of calcium acrylate was easily removed and no gluing of the fiber was observed. The percent graft, that is, the weight increase, was 20.9%.

As a test of the heat shrinkage the grafted fiber was heated in a 5° C./minute in air and the shrinkage at 150° C. was 23%.

It is certain that the heat-shrinking of polyvinyl chloride fiber is markedly reduced by the graft copolymerization of calcium acrylate.

The grafted fiber is dyed in a clear color with cationic dyestuffs such as "Cevlon Brilliant Red B2".

The graft fiber of the invention is regarded to be flame-resistant and self-extinguishing based on the fact that the fiber faintly burns only when it is in contact with a flame is extinguished immediately after the removal of the flame from the test fiber.

The strength of the grafted fiber was determined using an Instron Tester. The strength of the fiber with 20.9% graft was 10.3 g and that of the starting fiber was 15.6 g. It may be concluded that the drop of the strength by the grafting process is only slight.

COMPARATIVE EXAMPLES 2

No grafted fiber was obtained in an experiment similar to Example 10 except that the pre-treatment with a binary solution of ethylene dichloride and methyl alcohol was omitted.

The fiber caused marked shrinking and deterioration when a soaking solution of ethylene dichloride and methyl alcohol with a volume ratio of 50:50 was used for the impregnation in the first step instead of the soaking solution with a volume ratio of 30:70.

The percent graft was only 2.3% when a soaking solution containing ethylene dichloride and methyl alcohol in a volume ratio of 20:80 was used for the impregnation in the first step instead of the volume ratio of 30:70.

EXAMPLE 11

An experiment was carried out in a similar manner as to Example 10 except that a mixture of ethylene dichloride and methyl alcohol in a volume ratio of 40:60 was used for swelling the fiber instead of a mixture with a volume ratio of 30:70. The formation of the homopolymer outside of the fiber was so slight that the solution only became turbid. The percent graft of the treated fiber was 22.1%.

The shrinking of the grafted fiber at 150° C. was 20% and it was self-extinguishing. The strength of the fiber was 9.8 g.

Thus improved fiber with higher heat resistance was obtained without injuring the flame-retardance and the strength.

EXAMPLE 12

An experiment was carried out in a similar manner as to Example 10 except that the duration of the irradiation was 7 hours instead of 3 hours. The formation of the homopolymer was, in this case also, so slight that the solution only became turbid and that no gluing of the fiber occured. The percent graft of the treated fiber was 33.9%.

The heat-shrinking of the fiber at 150° C. was 11%. The fiber was easily dyeable and self-extinguishing. The strength of the grafted fiber was 11.3 g.

EXAMPLE 13 to EXAMPLE 16

Polyvinyl chloride fiber as used in Example 10 was subjected to the impregnation of the first step for 1 hour using a similar mixture of ethylene dichloride and methyl alcohol in a volume ratio of 30:70 at room temperature. Then the fiber was irradiated in a similar manner as to Example 10 except that 20% aqueous calcium acrylate solution was used for the impregnation of the second step after an addition of one of the metallic salts shown in Table 2 in a concentration of $10^{-2}$ mole/liter instead of Mohr's salt in Example 10, and that the irradiation was carried out with gamma rays at a dose rate of $2.0\times10^3$ rad/hour for a varied time shown in Table 2. The results of the testings are given in Table 2 with those of Comparative Example 3.

Table 2

| Ex. Nos. | Metallic Salt | Time of Irrad'n (hrs) | Percent Graft (%) | Monomer Sol'n Outside of the Fiber | Shrinkage at 150° C. (%) | Dyeability | Strngth (g) |
|---|---|---|---|---|---|---|---|
| 13 | cuprous chloride | 3 | 17.5 | faintly turbid | 24 | good | 10.5 |
| 14 | cupric sulfate | 4 | 15.0 | faintly turbid | 25 | good | 10.3 |
| 15 | ferrous chloride | 2 | 18.0 | turbid | 24 | good | 10.8 |
| 16 | ferric chloride | 2 | 18.0 | turbid | 23 | good | 11.0 |
| Comp. Ex. 3 | none | 2 | fiber glued | solidified | 60 | — | — |

The formation of the homopolymer in the liquid phase outside of the fiber was so slight that the solution only became turbid to some extent in every example where a water-soluble metallic salt selected from cuprous chloride, cupric sulfate, ferrous chloride or ferric chloride was added to the soaking solutions. The homopolymer was easily removed by successive washings with water and ethyl alcohol in these examples. The grafted fibers showed reduced heat-shrinkage compared with the starting fiber and good dyeability. The strength of the fiber was not reduced by the treatment for the grafting. Every graft fiber was self-extinguishing in the flame-retardance tests.

COMPARATIVE EXAMPLE 4

A large amount of the homopolymer of calcium acrylate was formed outside of the fiber in an experiment in which an aqueous solution of calcium acrylate was used without adding any metallic salt. The fiber was glued and could not be taken out from the solution in a good state.

EXAMPLE 17

An experiment was carried out in a similar manner as to Example 10. The polyvinyl chloride fiber was soaked in a binary mixture of ethylene dichloride and methyl alcohol at first, then dipped in an aqueous solution of calcium acrylate with a concentration of 30% by weight under an addition of Mohr's salt for 2 minutes, and then pressed gently to impregnate the solution in an amount almost equal to the starting fiber. The irradiation was carried out in a similar manner as to Example 9 with electron beams with of 1.5 MeV and 50 μA generated by a Van de Graaff-Type accelerator a dose rate of 0.2 Mrad/second. The percent graft of the resultant fiber was 18.4%.

The grafted fiber was not glued and obtained in a good state. The shrinkage of the fiber at 150° C. was 22.9% and the fiber was satisfactorily dyeable with cationic dyestuffs. It was self-extinguishing by the flame-retardance test. The strength of the grafted fiber was 10.9 g.

Thus improved fiber with good heat resistance was obtained without injuring the flame-retardance and the properties relating to the mechanical strength.

What is claimed is:

1. A method for manufacturing heat-resistant and flame-retardant polyvinyl chloride fiber which is characterized in comprising successive steps of ($a_1$) impregnating the polyvinyl chloride fiber with a ternary mixture of acrylic acid, water and ethylene dichloride in such a composition that the volume ratio of acrylic acid to water is at least 30/70 and the amount of ethylene dichloride is 90 to 100% of the minimum amount above which phase separation of the ternary mixture occurs, ($b_1$) irradiating the impregnated polyvinyl chloride fiber with ionizing radiation to cause graft-copolymerization of acrylic acid in an amount at least 15% by weight of the starting fiber, and ($c_1$) subjecting the grafted fiber to a heat treatment or converting the graft-copolymerized acrylic acid to a salt of a divalent metal by contacting the grafter fiber with an aqueous solution of a water-soluble divalent metal salt.

2. The method for manufacturing heat-resistant and flame-retardant polyvinyl chloride fiber according to claim 1, in which said ionizing radiation is electron beams.

3. The method for manufacturing heat-resistant and flame-retardant polyvinyl chloride fiber according to claim 1, in which said water-soluble divalent metal salt is selected from calcium acetate, zinc acetate, cupric acetate, nickel acetate and lead acetate.

4. A method for manufacturing heat-resisting and flame-retardant polyvinyl chloride fiber which is characterized in comprising a step of irradiating polyvinyl chloride fiber with ionizing radiation in contact with a mixture of calcium acrylate, water, methyl alcohol and ethylene dichloride, ethylene dichloride being present in an amount up to that which is sufficient just to cause phase separation and the mixture further contains at least one water-soluble metallic salt selected from the group consisting of ferrous, ferric, cuprous and cupric salts to supress the homopolymerization of calcium acrylate outside of the fiber.

5. The method for manufacturing heat-resistant and flame-retardant polyvinyl chloride fiber according to claim 4, in which the concentration of calcium salt of acrylic acid in the mixture is not less than 5% by weight.

6. The method for manufacturing heat-resistant and flame-retardant polyvinyl chloride fiber according to claim 4, in which said mixture contains from 20 to 100 parts by volume of methyl alcohol per 100 parts by volume of water.

7. The method for manufacturing heat-resistant and flame-retardant polyvinyl chloride fiber according to claim 4, in which said mixture contains the water-soluble metallic salt(s) in a concentration from $10^{-3}$ to $10^{-1}$ mole/liter.

8. The method for manufacturing heat-resistant and flame-retardant polyvinyl chloride fiber according to claim 4, in which said ionizing radiation is selected from gamma rays emitted from a cobalt-60 source, electron beams and X-rays.

9. The method for manufacturing heat-resistant and flame-retardant polyvinyl chloride fiber according to claim 4, in which the total dose of said ionizing radiation used to irradiate polyvinyl chloride fiber is in a range from 0.1 Mrad to 2 Mrad.

10. A method for manufacturing heat-resistant and flame-retardant polyvinyl chloride fiber which is characterized in comprising successive steps of ($a_3$) impregnating polyvinyl chloride fiber with a binary mixture of ethylene dichloride and methyl alcohol mixed in a volume ratio between 40:60 and 30:70, and ($b_3$) irradiating the impregnated polyvinyl chloride fiber with ionizing radiation in contact with aqueous solution of calcium salt of acrylic acid containing at least one water-soluble metallic salts selected from the group consisting of ferrous, ferric, cuprous and cupric salts to cause graft-copolymerization of calcium salt of acrylic acid in an amount at least 15% by weight based on the starting fiber.

11. The method for manufacturing heat-resisting and flame-retardant polyvinyl chloride fiber according to claim 10, in which the concentration of calcium acrylate in the aqueous solution is at least 5% by weight.

12. The method for manufacturing heat-resistant and flame-retardant polyvinyl chloride fiber according to claim 10, in which said aqueous solution contains the water-soluble metallic salt(s) in a concentration in the range of from $10^{-3}$ to $10^{-1}$ mole/liter.

13. The method for manufacturing heat-resistant and flame-retardant polyvinyl chloride fiber according to claim 10, in which said ionizing radiation is selected from gamma rays emitted from a cobalt-60 source, electron beams and X-rays.

14. The method for manufacturing heat-resistant and flame-retardant polyvinyl chloride fiber according to claim 10, in which the total dose of said ionizing radiation used to irradiate the polyvinyl chloride fiber is in the range from 0.1 Mrad to 2 Mrad.

* * * * *